US008500923B2

(12) United States Patent
Fukaya et al.

(10) Patent No.: US 8,500,923 B2
(45) Date of Patent: Aug. 6, 2013

(54) HIGH ALUMINUM FERRITIC STAINLESS STEEL SHEET FOR WEIGHT SENSOR SUBSTRATE, METHOD FOR PRODUCING THE SAME AND WEIGHT SENSOR

(75) Inventors: Masuhiro Fukaya, Tokyo (JP); Tadashi Komori, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 618 days.

(21) Appl. No.: 12/152,505

(22) Filed: May 14, 2008

(65) Prior Publication Data

US 2008/0245162 A1 Oct. 9, 2008

Related U.S. Application Data

(62) Division of application No. 10/928,551, filed on Aug. 26, 2004, now abandoned.

(30) Foreign Application Priority Data

Nov. 20, 2003 (JP) ..... 2003-391292

(51) Int. Cl.
*C22C 38/18* (2006.01)

(52) U.S. Cl.
USPC ..... 148/325; 420/34

(58) Field of Classification Search
USPC ..... 148/325; 420/34
See application file for complete search history.

(56) References Cited

U.S. PATENT DOCUMENTS

| | | | | |
|---|---|---|---|---|
| 5,405,460 | A * | 4/1995 | Yamanaka et al. | 148/522 |
| 6,264,236 | B1 | 7/2001 | Aoki | |
| 6,296,953 | B1 * | 10/2001 | Linden et al. | 428/681 |

FOREIGN PATENT DOCUMENTS

| | | | |
|---|---|---|---|
| JP | 3-20682 | | 3/1991 |
| JP | 04147944 | * | 5/1992 |
| JP | 05-093659 | * | 4/1993 |
| JP | 5-93659 | | 4/1993 |
| JP | 10-38733 | | 2/1998 |
| JP | 10251810 | * | 9/1998 |
| JP | 10273759 | * | 10/1998 |
| JP | 11-304579 | | 11/1999 |
| JP | 2000-180255 | | 6/2000 |
| JP | 2000319729 | * | 11/2000 |
| JP | 2002-105606 | | 4/2002 |
| WO | 0100896 | * | 1/2001 |

* cited by examiner

*Primary Examiner* — Sikyin Ip
(74) *Attorney, Agent, or Firm* — Kenyon & Kenyon LLP

(57) ABSTRACT

The present invention provides a stainless steel as a metal base material for a weight sensor substrate of an automobile airbag. The stainless steel sheet contains a high aluminiferous ferritic stainless steel containing, in mass, Al of 2.5 to 8%, C: 0.025% or less, N: 0.025% or less, the sum of C and N being 0.030% or less, and Nb: 0.05 to 0.5%, with the balance Fe and unavoidable impurities. Said stainless steel sheet may further contain, in mass, one or more of V: 0.05 to 0.4%, Ti: 0.02 to 0.2%, and Zr: 0.02 to 0.2%.

The present invention controls the difference in the average linear expansion coefficient between said stainless steel sheet and crystallized glass for said weight sensor to less than 10% in the temperature range from 20° C. to 900° C. and thus to improve the adhesiveness of said stainless steel sheet with said crystallized glass.

5 Claims, 2 Drawing Sheets

HIGH ALUMINUM FERRITIC STAINLESS STEEL SHEET FOR WEIGHT SENSOR SUBSTRATE, METHOD FOR PRODUCING THE SAME AND WEIGHT SENSOR

This application is a divisional application under 35 U.S.C. §120 and §121 of prior application Ser. No. 10/928,551, now abandoned, filed Aug. 26, 2004.

TECHNICAL FIELD

The present invention relates to a high aluminiferous ferritic stainless steel sheet for the weight sensor substrate of an automobile airbag, a method for producing the ferritic stainless steel sheet, and a weight sensor.

BACKGROUND ART

An automobile is equipped with seatbelts and airbags as devices for securing the safety of occupants. In recent years, in order to further improve the performance of a seatbelt and an airbag, there has been a tendency to control the movement of such safety facilities in conformity with an occupant's weight (body weight). For example, the expansion gas volume and expansion speed of an airbag and the pretensioning of a seatbelt are adjusted in conformity with an occupant's weight. For that purpose, it is necessary to know the weight of an occupant in a seat by some sort of means. As an example of such means, a means of disposing load sensors (load cells) at the four corners of a seat rail assembly, adding up the loads in the vertical direction imposed on the load cells, and by so doing measuring the weight of a seat including an occupant's weight has been proposed (Japanese Unexamined Patent Publication No. H11-304579).

With regard to a mechanical quantity sensor for detecting load, pressure, etc., various sensors has been proposed in accordance with the kind of a substrate and the kind of a strain sensitive material used for a resistive element. Typical proposed examples are: (1) a sensor produced by using a film comprising a resin such as polyester, epoxy, polyimide or the like as a substrate and forming on the surface of the substrate a lamellar resistive element comprising Cu—Ni alloy, Ni—Cr alloy or the like by vapor deposition or sputtering, (2) a sensor produced by using a glass plate instead of the aforementioned resin film (Japanese Examined Patent Publication No. H3-20682), and (3) a sensor produced by using a metal base material the surface of which is covered with a crystallized glass layer as a substrate and forming a resistive element on the surface thereof by coating it with paste and baking it (Japanese Unexamined Patent Publication No. H5-93659).

The magnitude of a mechanical quantity is measured in the following way. When a force or a load is imposed on a mechanical quantity sensor from outside, a resistive element formed on the surface of a substrate deforms together with the substrate. The imposed mechanical quantity is detected by measuring the change of an electric resistance between a pair of electrodes formed by connecting the resistive element, the change of the electric resistance being caused by the change of the length and sectional area of the resistive element. A mechanical quantity sensor that uses a metal base material on the surface of which a crystallized glass layer is formed as a substrate is most suitable as a sensor used under a harsh environment because, unlike other types of sensors, each of the component elements interdiffuses between the metal base material and the crystallized glass layer and also between the crystallized glass layer and a resistive element, and thus the adhesiveness between them is very strong. As a resistive element of a mechanical quantity sensor of this type, an element formed by being coated with resistive paste containing ruthenium oxide that functions as a resistive material, then dried and baked is known.

As metal base materials used for mechanical quantity sensors, a vitreous enamel steel, a stainless steel, a silicon steel, various alloy materials such as nickel-chromium-iron, nickel-iron, Kovar, Invar, etc., clad materials of those alloy materials and the like can be selected. Japanese Unexamined Patent Publication No. 2000-180255 discloses a technology that uses a stainless steel sheet as a metal base material. Japanese Unexamined Patent Publication No. H10-38733 discloses a technology that uses SUS 430 as a metal base material from the viewpoint of the adhesiveness with an insulating glass layer. Japanese Unexamined Patent Publication No. H5-93659 discloses a technology that uses SUS 430 concretely as a metal base material from the viewpoint of the necessity of coordinating the expansion coefficient thereof with that of a glass layer.

However, with a metal base material based on the aforementioned existing technologies, glass adhesiveness and high temperature oxidation resistance during baking are insufficient and therefore the metal base material has not been put into practical use. It is preferable that a sensor substrate is made of a stainless steel sheet and that an insulating glass layer and the layers of a resistive element and electrodes are solidified by baking (the schematic illustration is shown in FIG. 1). In this light, a stainless steel that has a high thermal resistance and an excellent glass adhesiveness so that sensor members may be baked together when each of the layers is baked at a high temperature has strongly been longed for.

When a crystallized glass layer functioning as an insulating layer, a strain sensitive resistive element and electrodes are baked and resultantly solidified in the form of layers onto a stainless steel sheet functioning as the substrate of a sensor, it is necessary to coordinate the linear expansion coefficients of a metal base material and a glass layer with each other in order to improve the adhesiveness between them. Since the baking is applied at a temperature of 900° C. or lower, it is necessary for the linear expansion coefficients of the metal base material and the glass layer to approximate each other, not only in the vicinity of room temperature but also in the temperature range from 20° C. to 900° C. If the difference in the average linear expansion coefficient is large between a metal base material and a crystallized glass layer, the adhesiveness between them deteriorates considerably and therefore they do not function as the substrate of a resistive element. Whereas the average linear expansion coefficient of generally used crystallized glass is 13 to $16\times10^{-6}$/° C., that of a conventionally used stainless steel is about $13\times10^{-6}$/° C. Accordingly, the difference in the average linear expansion coefficient is too large between the stainless steel substrate and the glass layer, and thus sufficient glass adhesiveness cannot be obtained.

SUMMARY OF THE INVENTION

The object of the present invention is, by providing a stainless steel most suitable as a metal base material for the weight sensor substrate of an automobile airbag, to improve high temperature oxidation resistance when the stainless steel substrate is sintered with a crystallized glass layer and thus to enhance the adhesiveness thereof with the glass layer.

The present invention has been established as a result of studying components, production methods, linear expansion coefficients and high temperature oxidation resistance in order to attain the above object, and it has been found that the object can be achieved by applying to a metal base material a steel sheet produced containing Nb, preferably further V, Ti and Zr, in a high aluminiferous ferritic stainless steel sheet. The gist of the present invention is as follows.

Specifically, the object of the present invention is attained by a high aluminiferous ferritic stainless steel sheet and a method for producing the stainless steel sheet according to the following points (1) to (7).

(1) A high aluminiferous ferritic stainless steel sheet for a weight sensor substrate, characterized by comprising a high aluminiferous ferritic stainless steel containing, in mass, Cr: 12 to 30%, Al: 2.5 to 8%, Nb: 0.05 to 0.5%, C: 0.025% or less, and N: 0.025% or less, the sum of C and N being 0.030% or less, with the balance consisting of Fe and unavoidable impurities.

(2) A high aluminiferous ferritic stainless steel sheet for a weight sensor substrate according to the item (1), characterized in that said high aluminiferous ferritic stainless steel further contains, in mass, one or more of V: 0.05 to 0.4%, Ti: 0.02 to 0.2%, and Zr: 0.02 to 0.2%.

(3) A high aluminiferous ferritic stainless steel sheet for a weight sensor substrate according to the item (1) or (2), characterized in that the average linear expansion coefficient of said stainless steel is 13.5 to $15.5\times10^{-6}$/° C. in the temperature range from 20° C. to 900° C.

(4) A high aluminiferous ferritic stainless steel sheet for a weight sensor substrate according to the item (1) or (2), characterized in that the difference in the average linear expansion coefficient between said stainless steel sheet and crystallized glass for a weight sensor is less than 10% in the temperature range from 20° C. to 900° C.

(5) A high aluminiferous ferritic stainless steel sheet for a weight sensor substrate according to the item (1) or (2), characterized in that the thickness of the oxide film of said stainless steel sheet is less than 0.38 μm.

(6) A method for producing a high aluminiferous ferritic stainless steel sheet for a weight sensor substrate, characterized by stamping said high aluminiferous ferritic stainless steel sheet according to the item (1) or (2) into a desired shape and successively applying heat treatment for 20 to 120 minutes in the temperature range from 800° C. to 900° C.

(7) A weight sensor characterized by being composed of: a weight sensor substrate comprising said high aluminiferous ferritic stainless steel sheet according to the item (1) or (2); a crystallized glass layer with which the surface of said substrate is covered; strain sensitive resistive elements formed on the surface of said crystallized glass layer; and a pair of electrodes for detecting the change of the electric resistance of said strain sensitive resistive elements.

The high aluminiferous ferritic stainless steel sheet of the present invention is a substrate material excellent in glass adhesiveness and high temperature oxidation resistance and is inevitable technology for sensor substrate material with which an insulating layer is adhered.

THE MOST PREFERRED EMBODIMENT

The present invention is hereunder explained in detail.

The present invention has been established as a result of studying the components of stainless steels, production methods, linear expansion coefficients and high temperature oxidation resistance, and provides a material excellent in glass adhesiveness used for a weight sensor substrate of an automobile airbag by adopting as the metal base material a stainless steel sheet produced containing Nb in a high aluminiferous ferritic stainless steel sheet and preferably further containing V, Ti and Zr therein.

Firstly, the reasons for limiting the ranges of the components in a stainless steel according to the present invention are explained.

Cr: Cr is the most fundamental element in securing the thermal resistance or high temperature oxidation resistance of a stainless steel. In the present invention, when a Cr content is less than 12 mass %, such properties are secured insufficiently and in contrast, when Cr is contained in excess of 30 mass %, particularly the toughness and ductility of a hot-rolled steel strip deteriorate considerably and the producibility of the material also deteriorates. For these reasons, a Cr content is limited in the range from 12 to 30 mass %, preferably from 14.5 to 16 mass %.

Figure 2:
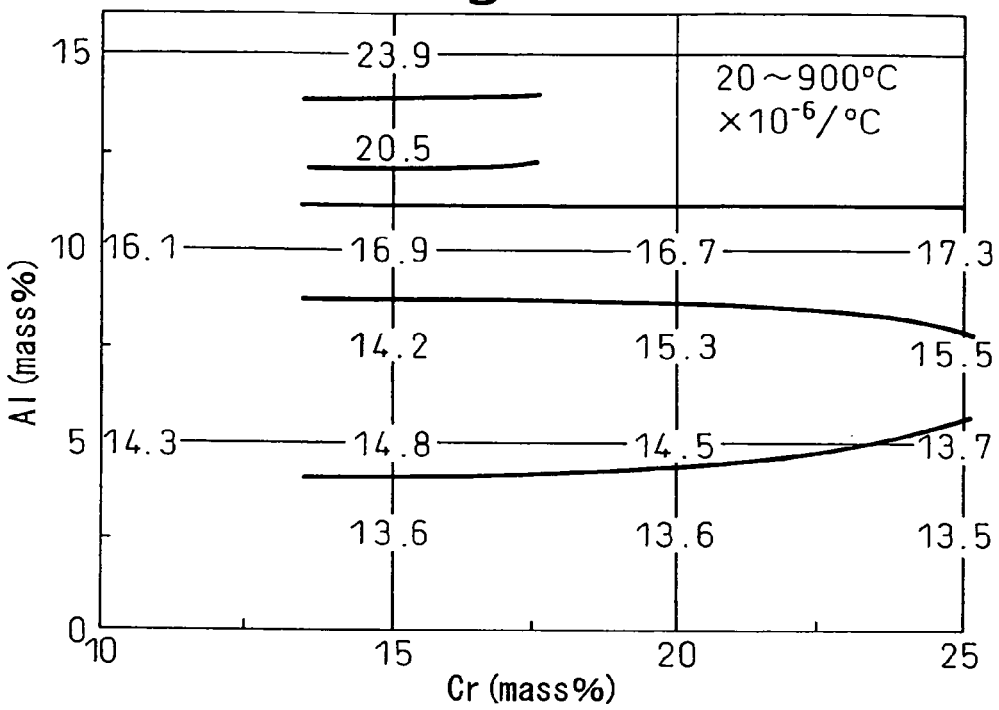
FIG. 2 is a graph showing the distribution of average linear expansion coefficients in the range from the room temperature (20° C.) to 900° C. in relation to the contents of Cr and Al of the stainless steel.
Figure 3:
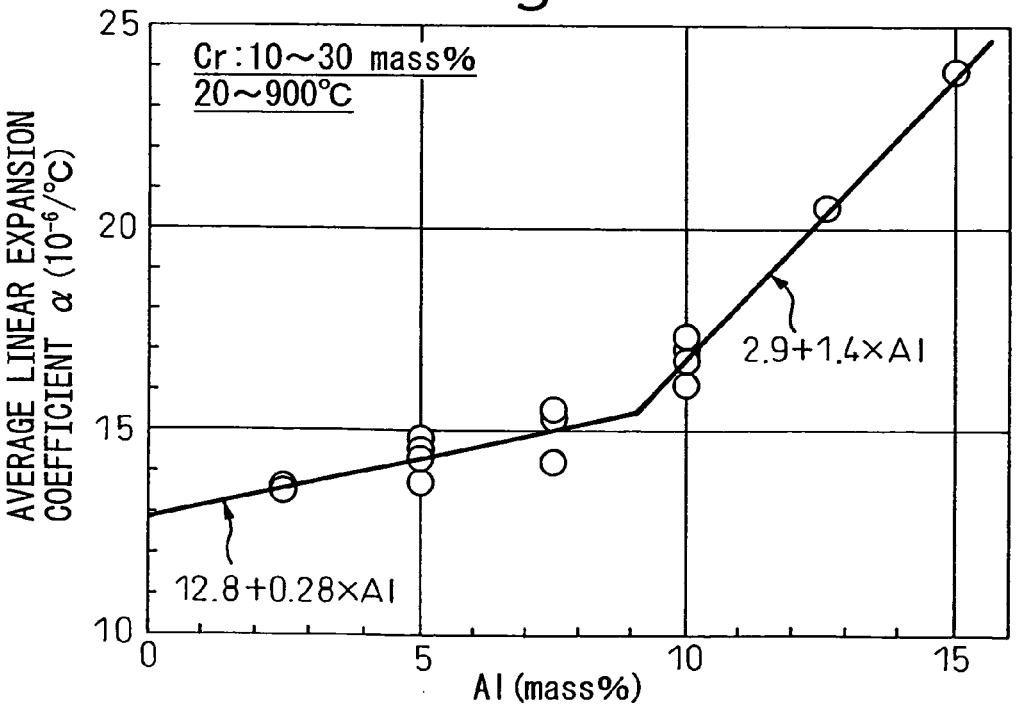
FIG. 3 is a graph showing the relationship between an Al content and an average linear expansion coefficient of the stainless steel in the range from the room temperature (20° C.) to 900° C.

Al: Al is an element that remarkably improves the high temperature oxidation resistance and specific resistance of a ferritic stainless steel. In addition to that, as an Al content increases, a linear expansion coefficient increases. Therefore, in the present invention, it is possible to make the linear expansion coefficient of a ferritic stainless steel coordinate with and approximate various linear expansion coefficients of various crystallized glass layers by alloy design wherein mainly an Al mass % is adjusted. FIG. 2 shows the distribution of average linear expansion coefficients in the range from room temperature (20° C.) to 900° C. in relation to the contents of Cr and Al of the stainless steel. It is understood that an average linear expansion coefficient depends not on a Cr content but on an Al content. FIG. 3 shows the relationship between an Al content and an average linear expansion coefficient of the stainless steel. The approximate expression of an average linear expansion coefficient $\alpha$ in the range from the room temperature (20° C.) to 900° C. is 12.8+0.28×(Al mass %) when an Al content is about 8 to 9 mass % or lower, and 2.9+1.4×(Al mass %) when an Al content exceeds about 9 mass %. As stated above, the average linear expansion coefficient of generally used crystallized glass is 13 to $16\times10^{-6}$/° C., and therefore it becomes possible to control the difference in the linear expansion coefficient between a stainless steel substrate and employed crystallized glass within an allowable range by adjusting an Al content in the range of 8 mass % or less. Further, with regard to the influence of Al on high temperature oxidation resistance, whereas the high temperature oxidation resistance is insufficient with an Al content of 2.5 mass % or less, when Al is contained in excess of 8 mass %, not only the average linear expansion coefficient increases rapidly but also the toughness of a hot-rolled steel strip deteriorates considerably and thus the producibility of the material also deteriorates. For these reasons, an Al content is limited in the range from 2.5 to 8 mass %, preferably 4 to 6 mass %.

A stainless steel sheet according to the present invention is a high aluminiferous stainless steel sheet and the toughness thereof lowers after hot rolling. Therefore, it is necessary to secure toughness in order to improve workability. The present invention is aimed at securing the toughness of a steel sheet by regulating components as follows.

C and N: C and N, when they are contained in excess of 0.025 mass % respectively, deteriorate the toughness of a hot-rolled steel strip which is the raw material of a cold-rolled steel sheet and the producibility of the material, namely cold-rolling operability. Therefore, the contents of C and N are limited to 0.025 mass % or less respectively and the sum of C and N is limited to 0.030 mass % or less. Preferably, the contents of C and N are 0.010 mass % or less respectively and the sum of C and N is also 0.010 mass % or less.

Nb: Nb is an element that forms carbonitride, thus prevents Cr carbide from precipitating at grain boundaries, refines crystal grains, enhances the toughness of a hot-rolled steel strip, and thus improves the producibility of the material. Therefore, it is possible to enhance the toughness of a hot-rolled steel strip by containing Nb in a stainless steel according to the present invention. When an Nb content is less than 0.05 mass %, the effect is insufficient. In contrast, when an Nb content exceeds 0.5 mass %, workability deteriorates considerably at cold rolling. For those reasons, a Nb content is limited in the range from 0.05 to 0.5 mass %, preferably 0.1 to 0.3 mass %.

V: V can be added selectively in the present invention. V further enhances the toughness of a hot-rolled steel strip by the same effect as Nb. When a V content is less than 0.05 mass %, the effect is insufficient. In contrast, when a V content exceeds 0.4 mass %, workability deteriorates considerably at cold rolling. For those reasons, a V content is limited in the range from 0.05 to 0.4 mass %.

Ti: Ti can be added selectively in the present invention. Ti is an element that is effective in improving the high temperature oxidation resistance of a ferritic stainless steel and improves the adhesiveness of an oxide film. With a Ti content of 0.02 mass % or more, the effect can show up. However, an excessive addition of Ti deteriorates the toughness of a hot-rolled steel strip and also the producibility of the material. When a Ti content exceeds 0.2 mass % in particular, the deterioration of toughness is conspicuous. For these reasons, a Ti content is limited in the range from 0.02 to 0.2 mass %, preferably from 0.04 to 0.10 mass %.

Zr: Zr can be added selectively in the present invention. Zr exhibits the same effect as Ti does and is an element that is effective in improving the high temperature oxidation resistance of a ferritic stainless steel and improves the adhesiveness of an oxide film. With the addition of Zr by 0.02 mass % or more, the effect can be exhibited. In contrast, an excessive addition of Zr deteriorates not only oxidation resistance but also the toughness of a hot-rolled steel strip and thus the producibility of the material. When a Zr content exceeds 0.2 mass % in particular, the deterioration of toughness is conspicuous. For these reasons, a Zr content is limited in the range from 0.02 to 0.2 mass %, preferably 0.05 to 0.15 mass %.

A preferable method for hot rolling a high aluminiferous ferritic stainless steel sheet of low carbon and low nitrogen, to which Nb or Nb, V, Ti, and Zr are added in appropriate amounts according to the present invention, is described. Toughness can be enhanced remarkably by: finishing hot rolling a stainless steel slab containing components stipulated in the present invention in the recovery temperature range from 700° C. to the recrystallization temperature; controlling the sum of the reduction ratios in the recovery temperature range not exceeding a recrystallization temperature to 15% or higher; successively coiling the hot-rolled steel strip in the temperature range from higher than 500° C. to lower than 850° C.; and thereafter cooling it mandatorily. It is estimated that, by applying the final stage rolling in the recovery temperature range not exceeding the recrystallization temperature Ts (° C.) in hot rolling, the dislocations introduced during the rolling paths form sub-boundaries as an energetically stable rearranged structure and sub-grains are formed in the crystal grains of the structure after hot rolling.

Next, the characteristics of a stainless steel intended in the present invention are described. In the present invention, the difference in the average linear expansion coefficient between a high aluminiferous ferritic stainless steel sheet and crystallized glass for a weight sensor substrate is less than 10% in the temperature range from 20° C. to 900° C. When a crystallized glass layer functioning as an insulating layer, a strain sensitive resistive element and electrodes are baked and resultantly solidified in the form of layers onto a stainless steel sheet functioning as the substrate of a sensor, it is necessary to coordinate their linear expansion coefficients with each other in order to improve the adhesiveness between the metal base material and the glass layer. Baking is applied at 900° C. or lower and therefore it is desirable that the linear expansion coefficients are close to each other not only in the vicinity of the room temperature but also in the temperature range from 20° C. to 900° C. When the difference in the average linear expansion coefficient is more than 10%, the adhesiveness between a metal base material and a crystallized glass layer deteriorates considerably and therefore they do not function as the base of a resistive element. The average linear expansion coefficient of generally used crystallized glass is 13 to $16\times10^{-6}$/° C.

In the present invention, an appropriate average linear expansion coefficient of a high aluminiferous ferritic stainless steel sheet is 13.5 to $15.5\times10^{-6}$/° C. in the temperature range from 20° C. to 900° C. A linear expansion coefficient $\alpha$ is defined by the expression $L_T=L_{20}(1+\alpha T)$. Here, $L_{20}$ is a length at 20° C. and $L_T$ is a length at a temperature T. If the average linear expansion coefficient of a high aluminiferous ferritic stainless steel sheet according to the present invention is less than $13.5\times10^{-6}$/° C. or more than $15.5\times10^{-6}$/° C. in the temperature range from 20° C. to 900° C., the adhesiveness of the stainless steel sheet with a crystallized glass layer is not secured.

It is possible to control the difference in the linear expansion coefficient between a stainless steel sheet and crystallized glass to 10% or less by regulating an Al content of the stainless steel sheet in the range from 2.5 to 8 mass %.

A high aluminiferous ferritic stainless steel sheet according to the present invention is a cold-rolled annealed steel sheet produced by descaling and thereafter cold rolling a hot-rolled steel strip and successively applying annealing and descaling.

A cold-rolled steel sheet of a high aluminiferous ferritic stainless steel sheet according to the present invention is stamped into a desired shape and thereafter baked together with a glass layer. The baking is applied for 20 to 120 minutes at 800° C. to 900° C. When a baking temperature is lower than 800° C., the interdiffusion between a stainless steel sheet and a glass layer is insufficient and therefore the adhesiveness is also insufficient. On the other hand, when a baking temperature exceeds 900° C., the thermal resistance of a glass layer cannot withstand the temperature. Note that, a baking time here is defined by the total hours spent in plural heat treatments. When a baking time is shorter than 20 minutes, interdiffusion is insufficient and thus adhesiveness is also insufficient. On the other hand, when a baking time exceeds 120 minutes, an oxide film having the thickness of submicron order is formed due to the progress of oxidation, resulting in discoloration, so-called temper color, and the deterioration of resistance against temper color. The temper color does not directly affect the functions as a sensor but a color tone intrinsic to a stainless steel surface is lost.

In the present invention, the thickness of an oxide film formed on the surface of a stainless steel sheet in the baking treatment that is applied to the stainless steel sheet as well as a crystallized glass layer is less than 0.38 μm. When an oxide film thickness is 0.38 μm or more, it corresponds to the wavelength of visible light (0.38 to 0.78 μm) and therefore an interference color such as blue-green appears. When an oxide film thickness is less than 0.38 μm, such an interference color does not form and excellent temper color resistance is obtained.

Figure 1:
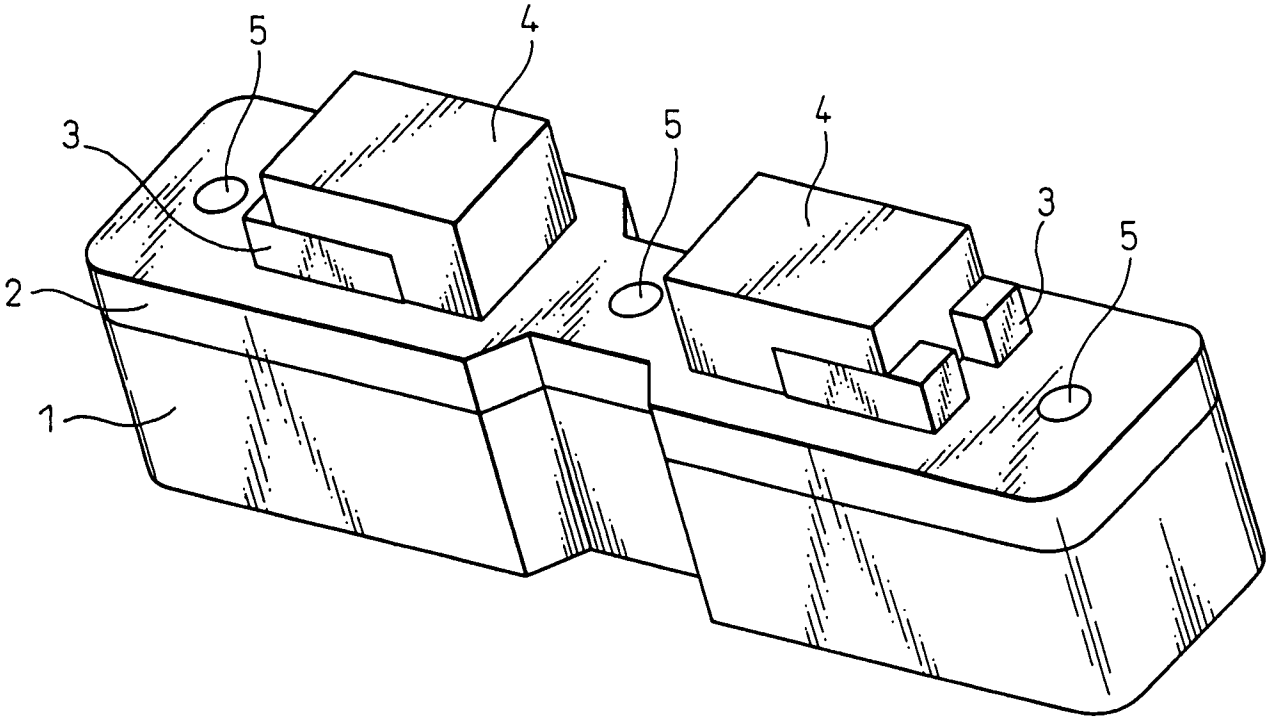
FIG. 1 is a schematic illustration showing a mechanical quantity sensor according to the present invention.

An automobile airbag weight sensor according to the present invention is, as shown in FIG. 1, a weight sensor characterized by being composed of: a substrate 1 comprising a metal base material of a high aluminiferous ferritic stainless steel sheet; a crystallized glass layer 2 with which the surface of the substrate is covered; strain sensitive resistive elements 4 formed on the surface of the crystallized glass layer; and a pair of electrodes 3 for detecting the change of the electric resistance of the strain sensitive resistive elements. Note that, in the weight sensor, volt holes 5 used for putting the weight sensor in place are provided. Since the adhesiveness of the substrate of a high aluminiferous ferritic stainless steel sheet with a crystallized glass layer 2 is good, it is possible to simultaneously apply baking treatment to a metal substrate 1, a crystallized glass layer 2, electrodes 3 and strain sensitive resistive elements 4, or to reduce the frequency of the baking treatment.

EXAMPLES

Next, the present invention is concretely explained on the basis of examples.

Example 1

High aluminiferous ferritic stainless steels shown in Table 1 were melted and refined by the converter AOD method or the vacuum melting method. These steels were subjected to surface conditioning, thereafter hot rolled at a hot-rolling finishing temperature in the range from 880° C. to 900° C., coiled at a hot-rolling coiling temperature in the range from 400° C. to 750° C., and cooled by water cooling, and thus hot-rolled steel strips 5 mm and 3.8 mm in thickness were produced. Successively, the hot-rolled steel strips were subjected to shot blasting and descaling by pickling, and thereafter cold rolled to the thickness of 3 mm and 2 mm. Successively, the cold-rolled steel strips were annealed at 920° C. and then subjected to salt treatment and descaling by pickling, and thus cold-rolled steel sheets were produced. With regard to crystallized glass, crystallized glass having the average linear expansion coefficient of $14.5\times10^{-6}$/° C. was used.

Here, evaluation tests were carried out by the following methods.

Contents of steel sheets were measured by sampling test pieces from the steel sheets and subjecting them to element analysis. C, S and N were measured by the gas analysis method (the method of melt in inert gas and thermal conduction measurement in the case of N, and the method of combustion in oxygen stream and infrared-absorbing analysis in the case of C and S), and the other elements were measured with a fluorescent X-ray analyzer (SHIMAZU, MXF-2100).

The producibility (cold workability) was evaluated by sampling a V-notched Charpy test piece of sub-size (5 mm or 3.8 mm in thickness) conforming to the JIS Standard in the direction parallel to the rolling direction, subjecting the test piece to an impact test, and measuring the temperature at which the impact value was 2 kgf/cm$^2$ (vT2: ° C.). In the case where a vT2 value exceeded 80° C., even though heating by warm water was applied beforehand, the risk of sheet breakage increased extremely due to an impact and the like when cold rolling was applied, thus it was substantially impossible to apply cold rolling, and therefore the case was evaluated as X. Any of the examples according to the present invention showed good producibility. The contents of C and C+N were beyond the upper limits in the case of the comparative example No. 11, the Cr content was beyond the upper limit in the case of the comparative example No. 12, the Al content was beyond the upper limit in the case of the comparative example No. 14, the contents of N and C+N were beyond the upper limits in the case of the comparative example No. 16, the Nb content was beyond the upper limit in the case of the comparative example No. 17, the Ti content was beyond the upper limit in the case of the comparative example No. 18, the Zr content was beyond the upper limit in the case of the comparative example No. 19, and the V content was beyond the upper limit in the case of the comparative example No. 20, and resultantly the producibility was poor in any case of the comparative examples.

The high temperature oxidation resistance was evaluated by using a sample the surface of which was polished to #400 in mesh and measuring the increment of oxidation amount after the heating for 120 minutes at 900° C. in the atmosphere. A case where the increment of the oxidation amount was not more than 0.2 mg/cm$^2$ was indicated as ○ and a case where the increment of the oxidation amount exceeded 0.2 mg/cm$^2$ was indicated as X. The Cr content was lower than the lower limit stipulated in the present invention in the case of the comparative example No. 13 (sample No. 13) and the Al content was lower than the lower limit stipulated in the present invention in the case of the comparative example No. 15 (sample No. 15), and resultantly the oxidation resistance was inferior in either case of the comparative examples.

The linear expansion coefficient was evaluated by adopting the test method stipulated in the ISO Standard and measuring an average linear expansion coefficient in the range from the room temperature (20° C.) to 900° C. A case where an average linear expansion coefficient was in the range from 13.5 to $15.5\times10^{-6}$/° C. was indicated as ○ and a case where it was lower than $13.5\times10^{-6}$/° C. or higher than $15.5\times10^{10-6}$/° C. was indicated as X. In the examples according to the present invention, the difference in the average linear expansion coefficient between a high aluminiferous ferritic stainless steel sheet and crystallized glass for a weight sensor substrate was within 10% in the temperature range from 20° C. to 900° C. In the case of the comparative example No. 15, the Al content was lower than the lower limit stipulated in the present invention and also the average linear expansion coefficient in the range from the room temperature to 900° C. was lower than the lower limit stipulated in the present invention.

The glass adhesiveness was evaluated by the tape peeling test JIS H8504 (a method for testing the adhesiveness of plating). A case where a crystallized glass layer exfoliated was indicated as X and a case where it did not exfoliate was indicated as ○. The glass adhesiveness of the metal base materials containing the components stipulated in the present invention improved considerably. In the case of the comparative example No. 15, the Al content was lower than the lower limit stipulated in the present invention and resultantly the glass adhesiveness was poor.

The resistance to temper color was judged by visually observing the existence of color development at visible wavelengths.

TABLE 1

| Classification | No. | Sample No. | Chemical components (mass %) C | Si | Mn | P | S | Cr | Al | N | Nb | V | Ti | Zr | C + N |
|---|---|---|---|---|---|---|---|---|---|---|---|---|---|---|---|
| Invented steel | 1 | 1 | 0.006 | 0.21 | 0.15 | 0.020 | 0.0021 | 15.09 | 4.71 | 0.0058 | 0.108 | | | | 0.0118 |
| | 2 | 2 | 0.003 | 0.21 | 0.14 | 0.020 | 0.0003 | 14.95 | 4.54 | 0.0042 | 0.204 | | | | 0.0072 |
| | 3 | 3 | 0.004 | 0.20 | 0.15 | 0.020 | 0.0003 | 14.94 | 4.46 | 0.0044 | 0.298 | | | | 0.0084 |
| | 4 | 4 | 0.006 | 0.21 | 0.15 | 0.020 | 0.0023 | 13.51 | 4.11 | 0.0061 | 0.213 | 0.249 | | | 0.0121 |
| | 5 | 5 | 0.003 | 0.20 | 0.14 | 0.020 | 0.0006 | 18.01 | 3.21 | 0.0040 | 0.301 | | 0.044 | | 0.0070 |
| | 6 | 6 | 0.005 | 0.21 | 0.14 | 0.019 | 0.0004 | 14.99 | 4.52 | 0.0040 | 0.100 | | | 0.08 | 0.0090 |
| | 7 | 7 | 0.003 | 0.20 | 0.14 | 0.020 | 0.0006 | 15.20 | 4.69 | 0.0040 | 0.211 | | 0.049 | | 0.0070 |
| | 8 | 8 | 0.005 | 0.21 | 0.14 | 0.019 | 0.0004 | 14.99 | 4.52 | 0.0040 | 0.100 | 0.153 | 0.143 | | 0.0090 |
| | 9 | 9 | 0.004 | 0.20 | 0.14 | 0.020 | 0.0003 | 15.00 | 4.51 | 0.0047 | 0.200 | | | 0.102 | 0.0087 |
| | 10 | 10 | 0.003 | 0.21 | 0.14 | 0.021 | 0.0007 | 15.01 | 4.48 | 0.0048 | 0.128 | 0.191 | | | 0.0078 |
| Comparative example | 11 | 11 | 0.034* | 0.21 | 0.14 | 0.020 | 0.0007 | 15.08 | 4.57 | 0.0041 | 0.252 | | 0.154 | | 0.0381* |
| | 12 | 12 | 0.006 | 0.21 | 0.15 | 0.020 | 0.0006 | 32.12* | 4.69 | 0.0061 | 0.212 | | 0.066 | | 0.0121 |
| | 13 | 13 | 0.005 | 0.21 | 0.15 | 0.020 | 0.0005 | 11.23* | 3.55 | 0.0055 | 0.198 | | | | 0.0105 |
| | 14 | 14 | 0.005 | 0.21 | 0.14 | 0.019 | 0.0004 | 15.20 | 9.55* | 0.0040 | 0.108 | | 0.161 | | 0.0090 |
| | 15 | 15 | 0.004 | 0.21 | 0.15 | 0.020 | 0.0004 | 15.19 | 2.44* | 0.0045 | 0.154 | | | | 0.0085 |
| | 16 | 16 | 0.003 | 0.20 | 0.14 | 0.020 | 0.0006 | 14.99 | 4.52 | 0.0410* | 0.299 | | 0.113 | | 0.0440* |
| | 17 | 17 | 0.005 | 0.21 | 0.14 | 0.019 | 0.0004 | 15.20 | 4.69 | 0.0040 | 0.608* | | | | 0.0090 |
| | 18 | 18 | 0.003 | 0.22 | 0.15 | 0.020 | 0.0004 | 14.95 | 4.54 | 0.0050 | 0.155 | | 0.253* | | 0.0080 |
| | 19 | 19 | 0.003 | 0.20 | 0.14 | 0.020 | 0.0006 | 14.99 | 4.52 | 0.0040 | 0.210 | | | 0.241* | 0.0070 |
| | 20 | 20 | 0.003 | 0.21 | 0.14 | 0.020 | 0.0006 | 15.02 | 4.46 | 0.0043 | 0.192 | 0.451* | | | 0.0073 |

| Classification | No. | Sample No. | Sheet thickness (mm) | Evaluation: Producibility (Cold workability) | High temperature oxidation resistance | Linear expansion coefficient at room temp. to 900° C. | Glass adhesiveness | Overall judgment |
|---|---|---|---|---|---|---|---|---|
| Invented steel | 1 | 1 | 2 | ○ | ○ | ○ | ○ | ○ |
| | 2 | 2 | 2 | ○ | ○ | ○ | ○ | ○ |
| | 3 | 3 | 3 | ○ | ○ | ○ | ○ | ○ |
| | 4 | 4 | 3 | ○ | ○ | ○ | ○ | ○ |
| | 5 | 5 | 3 | ○ | ○ | ○ | ○ | ○ |
| | 6 | 6 | 3 | ○ | ○ | ○ | ○ | ○ |
| | 7 | 7 | 3 | ○ | ○ | ○ | ○ | ○ |
| | 8 | 8 | 2 | ○ | ○ | ○ | ○ | ○ |
| | 9 | 9 | 3 | ○ | ○ | ○ | ○ | ○ |
| | 10 | 10 | 3 | ○ | ○ | ○ | ○ | ○ |
| Comparative example | 11 | 11 | 3 | X | — | — | — | X |
| | 12 | 12 | 3 | X | — | — | — | X |
| | 13 | 13 | 3 | ○ | X | ○ | ○ | X |
| | 14 | 14 | 3 | X | — | — | — | X |
| | 15 | 15 | 3 | ○ | X | X | X | X |
| | 16 | 16 | 3 | X | — | — | — | X |
| | 17 | 17 | 2 | X | — | — | — | X |
| | 18 | 18 | 2 | X | — | — | — | X |
| | 19 | 19 | 3 | X | — | — | — | X |
| | 20 | 20 | 3 | X | — | — | — | X |

The marks * show the figures are outside the relevant ranges stipulated in the present invention.

Example 2

The steel sheets of sample Nos. 7 and 3 shown in Table 1 were subjected to baking heat treatment under the conditions shown in Table 2. The crystallized glass having the average linear expansion coefficient of $14.5\times10^{-6}$/° C., which was the same as used in EXAMPLE 1, was used.

A coating film thickness was measured by GDS (Glow Discharge Emission Spectrometry). The measuring device was JY5000RF-PSS type made by JOBIN YVON (France) and the measurement area was 4 mm in diameter. A sputter speed was measured by the depth formed after subjecting a Japanese Iron and Steel Certified Reference Material JSS652-13 to the discharge for 250 seconds. As the samples for calibration, four kinds of specimens including Japanese Iron and Steel Certified Reference Materials JSS652-13, JSS171-1, JSS1001-1 and the like were used.

The invention example Nos. 7 and 19 to 21 were the cases where the baking conditions stipulated in the present invention were adopted and were excellent in both the glass adhesiveness and temper color resistance. In the case of the comparative example No. 22, the baking temperature was higher than the upper limit and thus all the glass adhesiveness, film thickness and temper color resistance were inferior. In the case of the comparative example No. 23, the baking time was longer than the upper limit and thus both the film thickness and temper color resistance were inferior. In the case of the comparative example No. 24, the baking time was shorter than the lower limit and thus the glass adhesiveness was poor. In the case of the comparative example No. 25, the baking temperature was lower than the lower limit and thus the glass adhesiveness was poor.

TABLE 2

| Classification | No. | Sample No. | Baking condition Temperature (° C.) | Baking condition Time (min.) | Evaluation Glass adhesiveness | Evaluation Film thickness | Evaluation Temper color resistance | Evaluation Overall judgment |
|---|---|---|---|---|---|---|---|---|
| Invention example | 7 | 7 | 850 | 110 | ○ | ○ | ○ | ○ |
| | 19 | 7 | 850 | 40 | ○ | ○ | ○ | ○ |
| | 20 | 3 | 850 | 110 | ○ | ○ | ○ | ○ |
| | 21 | 3 | 850 | 40 | ○ | ○ | ○ | ○ |
| Comparative example | 22 | 7 | 950* | 100 | X | X | X | X |
| | 23 | 7 | 850 | 150* | ○ | X | X | X |
| | 24 | 7 | 850 | 15* | X | ○ | ○ | X |
| | 25 | 7 | 750* | 100 | X | ○ | ○ | X |

The marks * show the figures are outside the relevant ranges stipulated in the present invention.

The invention claimed is:

1. A weight sensor substrate comprising a high aluminum ferritic stainless steel sheet consisting of, in mass, Cr: 12 to 16%, Al: 2.5 to 8%, Nb: 0.05 to 0.5%, C: 0.025% or less, and N: 0.025% or less, the sum of C and N being 0.030% or less, with the balance being Fe and unavoidable impurities, wherein an average linear expansion coefficient of said stainless steel is 13.5 to $15.5\times10^{-6}$/° C. in a temperature range from 20° C. to 900° C.

2. A weight sensor substrate according to claim 1, characterized in that the difference in the average linear expansion coefficient between said stainless steel sheet and a crystallized glass of a weight sensor is less than 10% in a temperature range from 20° C. to 900° C.

3. A weight sensor substrate according to claim 1, characterized in that a thickness of an oxide film of said stainless steel sheet is less than 0.38 μm.

4. A weight sensor characterized by being composed of: a weight sensor substrate comprising said high aluminum ferritic stainless steel sheet according to claim 1; a crystallized glass layer with which the surface of said substrate is covered; strain sensitive resistive elements formed on the surface of said crystallized glass layer; and a pair of electrodes for detecting a change of electric resistance of said, strain sensitive resistive elements.

5. A weight sensor substrate comprising a high aluminum ferritic stainless steel sheet consisting of, in mass, Cr: 12 to 16%.

Al: 2.5 to 8%,

Nb: 0.05 to 0.5%,

C: 0.025% or less, and

N: 0.025% or less, the sum of C and N being 0.030% or less, and one or more of

V: 0.05 to 0.4%,

Ti: 0.02 to 0.2%, and

Zr: 0.02 to 0.2%, wherein an average linear expansion coefficient of said stainless steel is 13.5 to $15.5\times10^{-6}$/° C. in a temperature range from 20° C. to 900° C.

* * * * *

UNITED STATES PATENT AND TRADEMARK OFFICE

CERTIFICATE OF CORRECTION

PATENT NO. : 8,500,923 B2
APPLICATION NO. : 12/152505
DATED : August 6, 2013
INVENTOR(S) : Masuhiro Fukaya et al.

It is certified that error appears in the above-identified patent and that said Letters Patent is hereby corrected as shown below:

In the Specification

Column 3, line 66, change "(20°C.) to 900°C." to -- 20°C to 900°C --;

Column 4, line 3, change "(20°C.) to 900°C." to -- 20°C to 900°C. --;

Column 4, line 42, change "(20°C.) to 900°C." to -- 20°C to 900°C --;

Column 4, line 49, change "(20°C.) to 900°C." to -- 20°C to 900°C --.

Signed and Sealed this
Fifth Day of August, 2014

Michelle K. Lee

Michelle K. Lee
*Deputy Director of the United States Patent and Trademark Office*